US005099555A

United States Patent [19]

Okuda

[11] Patent Number: 5,099,555

[45] Date of Patent: Mar. 31, 1992

[54] THREAD SEPARATING DEVICE WITH SENSOR CONTROLLED DISTANCE TRAVEL

[75] Inventor: Tetsuo Okuda, Gifu, Japan

[73] Assignee: CKD Corporation, Aichi, Japan

[21] Appl. No.: 601,662

[22] Filed: Oct. 25, 1990

[30] Foreign Application Priority Data

Oct. 25, 1989 [JP] Japan ..... 1-278823

[51] Int. Cl.[5] ..... D03J 1/16

[52] U.S. Cl. ..... 28/172.1; 28/202

[58] Field of Search ..... 28/201, 202, 204, 208, 28/172.1

[56] References Cited

U.S. PATENT DOCUMENTS 1,129,849 2/1915 Colman ..... 28/172.1
2,690,606 10/1954 Fleischer ..... 28/202
3,136,025 6/1964 Noone et al. ..... 28/202
5,003,675 4/1991 Esser et al. ..... 28/202 X

FOREIGN PATENT DOCUMENTS 48-37059 11/1973 Japan .
244578 5/1947 Switzerland ..... 28/202
329862 5/1930 United Kingdom ..... 28/202
2117419 10/1983 United Kingdom ..... 28/202

*Primary Examiner*—Werner H. Schroeder
*Assistant Examiner*—John J. Calvert
*Attorney, Agent, or Firm*—Wenderoth, Lind & Ponack

[57] ABSTRACT

A thread separating apparatus separates an outermost thread from a large number of threads arranged substantially parallel and in close proximity to each other within one plane. The apparatus has a movable table that is movable in a direction which is parallel to the plane in which the threads are arranged and which is substantially perpendicular to the threads. A thread guide member and a thread separating device project from the movable table in the direction of movement of the movable table. The guide member has a slit in which threads are to be aligned. The thread separating device has a pair of separating members which can be opened and closed as desired to separate the outermost thread from the other threads. The movable table is further provided with a detector for detecting in a non-contact manner a diameter of thread which is to be separated, and a switch that is activated by the separated thread.

14 Claims, 4 Drawing Sheets

THREAD SEPARATING DEVICE WITH SENSOR CONTROLLED DISTANCE TRAVEL

BACKGROUND OF THE INVENTION

The present invention relates to an apparatus for separating a large number of threads one by one, which are arranged substantially parallel and in close proximity to each other, as in the case of successively separating warp threads one by one in a step preparatory to weaving.

In one type of conventional warp separating apparatus, warp threads are diagonally set between a pair of spaced bars to enable the threads to be readily separated from each other, and the warp threads are then separated one by one, as disclosed in Japanese Patent Publication (KOKOKU) No. 48-37059 (1973). In another type of prior art apparatus, warp threads are displaced by catching each thread on a step portion of a bar and then are separated from each other by means of a hook.

However, the former prior art apparatus involves the problem that warp threads must be diagonally set in advance and this preparatory operation needs a great deal of time and labor. The latter prior art apparatus suffers from the problem that, when threads with a small diameter are densely arranged side by side, it is difficult to displace each thread with a stepped bar, so that an error in thread separation is likely to occur.

SUMMARY OF THE INVENTION

It is an object of the present invention to provide a thread separating apparatus which is capable of reliably separating threads one by one without the need for setting them diagonally in advance even in a case where thin threads are densely arranged side by side.

To this end, the present invention provides a thread separating apparatus which separates the outermost thread from a large number of threads arranged substantially parallel and in close proximity to each other within one plane, comprising: a movable table that is movable in a direction which is parallel to the plane in which the threads are arranged and which is substantially perpendicular to the threads; a thread guide member that projects from the movable table in the direction of movement of the movable table, the guide member having a slit in which threads are to be aligned; means for separating the outermost thread from the rest of the threads the means projecting from the movable table in the direction of movement of the movable table, and the means having a pair of separating members which can be opened and closed as desired; a detector for detecting in a non-contact manner a diameter of the thread which is to be separated, the detector being provided on the movable table; and a switch that is activated by the separated thread, the switch being provided on the movable table.

In the above-described apparatus, when the movable table moves and the detector detects the outermost thread which is to be separated, the movable table stops, and the detector measures the diameter of the thread. At this time, the pair of separating members of the separating means are open with respect to each other so that a thread can pass through the gap therebetween. Thereafter, the movable table is moved by a distance corresponding to the diameter of the thread measured by the detector. When the movable table stops, the separating members are closed to separate the outermost thread from the others and draw it into the slit. Consequently, the switch is activated to recognize that the thread has been separated.

DETAILED DESCRIPTION OF THE PREFERRED EMBODIMENT

One embodiment of the thread separating apparatus according to the present invention will be described below in detail with reference to the accompanying drawings.

Figure 1:
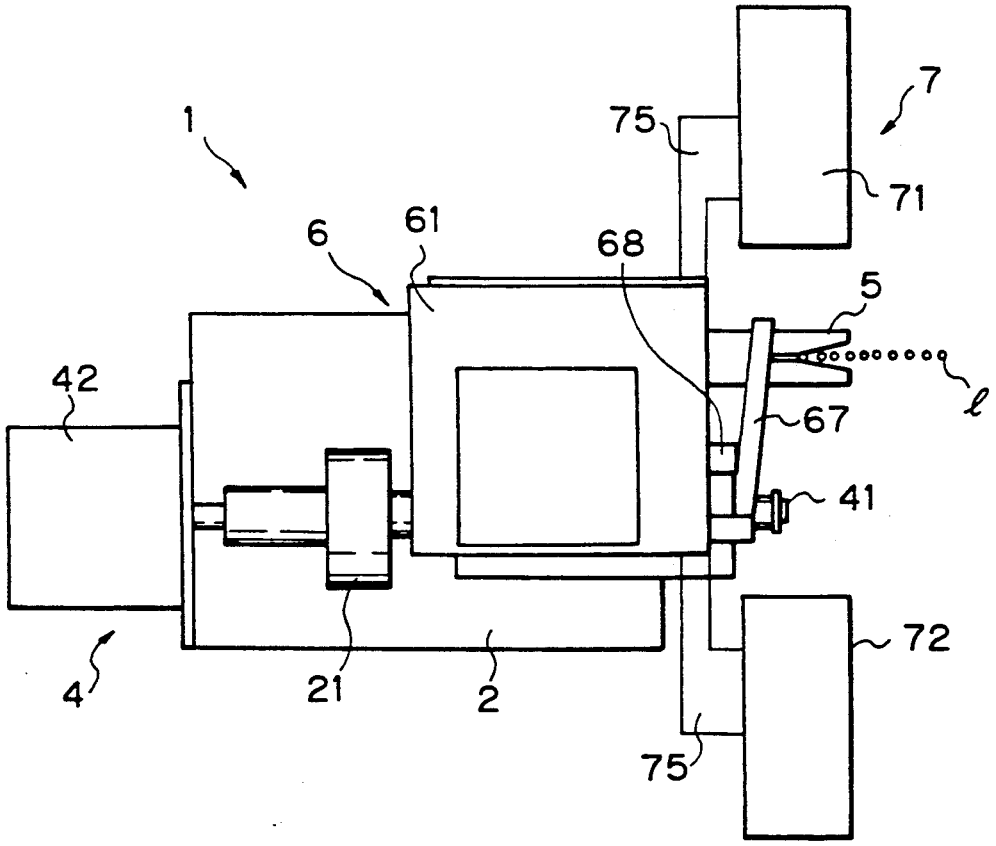
FIG. 1 is a plan view of one embodiment of the thread separating apparatus according to the present invention, with sone components removed therefrom.
Figure 2:
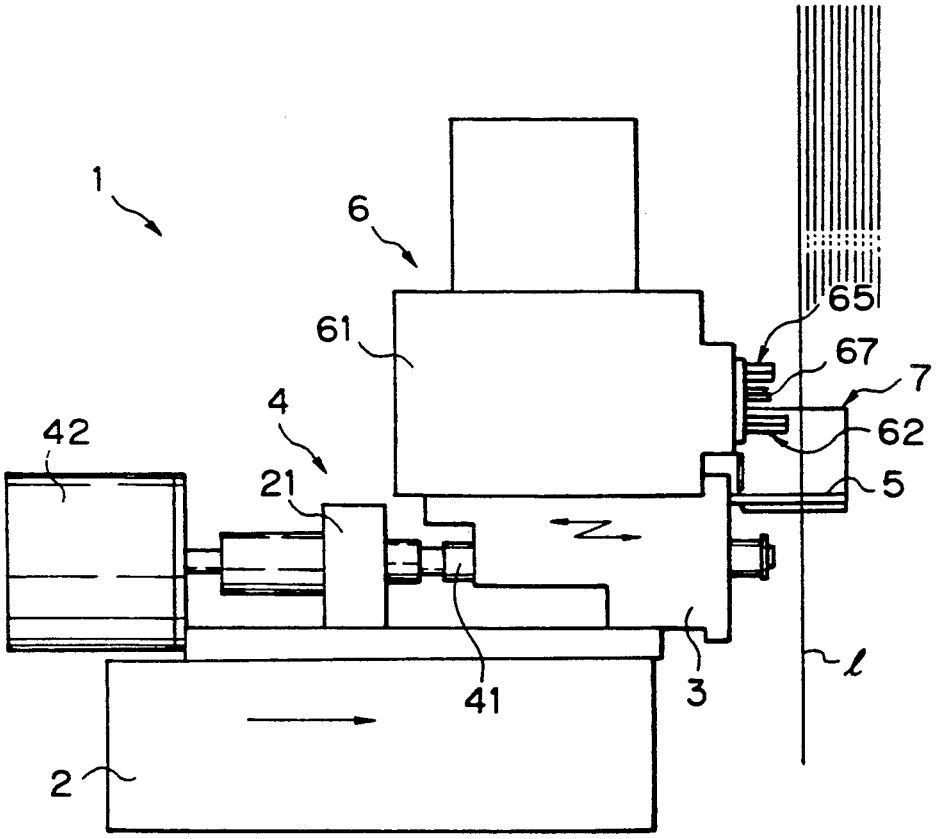
FIG. 2 is a side view of the apparatus shown in FIG. 1.
Figure 3:
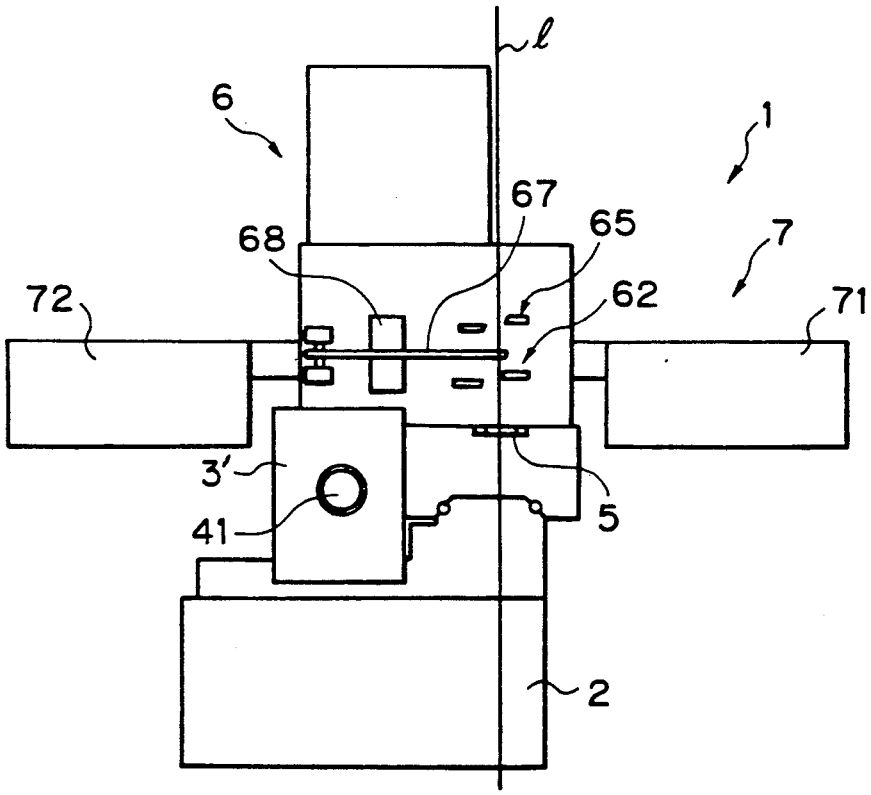
FIG. 3 is a front view of the apparatus shown in FIG. 1.

FIGS. 1 to 3 show a thread separating apparatus 1 according to one embodiment of the present invention. The thread separating apparatus 1 comprises a first movable table or feed table 2, a second movable table or slide table 3, which is supported on the feed table 2 in such a manner that the slide table 3 is reciprocatable only in a rectilinear direction (horizontally, or sidewardly, as viewed in FIG. 2) in a known manner, a drive mechanism 4 that causes the slide table 3 to reciprocate, a thread guide member 5 that is attached to the forward end face (the right end face as viewed in FIG. 2) of the slide table 3 in such a manner that the thread guide member 5 projects in the direction of movement of the slide table 3, a reaching unit 6 that is attached to the slide table 3, and a detector 7 that is attached to the slide table 3.

The drive mechanism 4 has a screw shaft 41 that extends horizontally (as viewed in FIG. 2) above the feed table 2 and that is rotatably supported by a bearing unit 21, and a pulse motor 42 that is coupled to the screw shaft 41. The screw shaft 41 is in threaded engagement with a tapped hole that extends through the slide table 3. Thus, as the screw shaft 41 is rotated by the pulse motor 42, the slide table 3 can be reciprocated horizontally with a high degree of accuracy.

Figure 4:
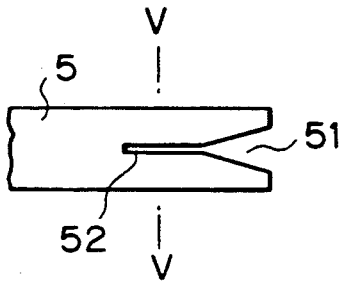
FIG. 4 is a plan view of a thread guide member.
Figure 5:
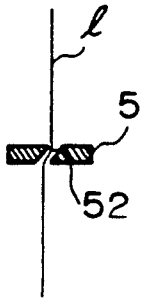
FIG. 5 is a sectional view taken along line V—V of FIG. 4.

The thread guide member 5 comprises a thin plate which has a divergent V-notch 51 formed at the forward end, as shown in FIGS. 4 and 5. The thread guide member 5 is further formed with a slit 52 that extends longitudinally (i.e., in the direction of movement of the slide table 3) from the bottom of the V-notch 51. The slit 52 extends diagonally with respect to the direction of extension of threads 1, as shown in FIG. 5 so that threads, when introduced into the slit 52, are aligned with each other within one plane.

The reaching unit 6 has a body 61 that is secured to the top of the slide table 3, a separating means, that is, separating hook 62, which projects from the forward end face (the right end face as viewed in FIG. 2) of the body 61 in the direction of advancement of the slide table 3, and a cutter 65 for cutting threads. The separating hook 62 and the cutter 65 are vertically spaced apart from each other in such a manner that the former is positioned below the latter.

Figure 6:
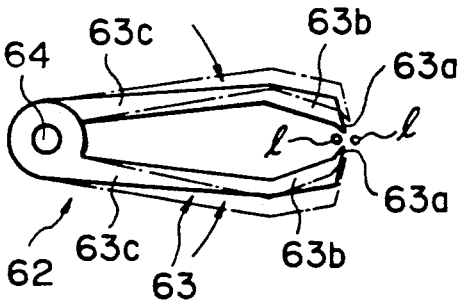
FIGS. 6 and 7 are plan views of a separating hook in different operative states.
Figure 7:
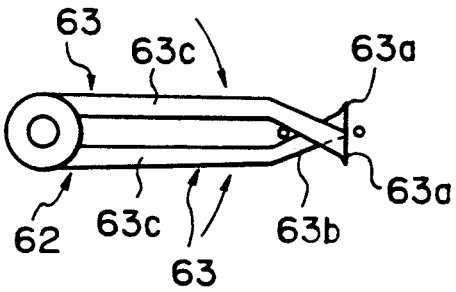

The separating hook 62 has a pair of separating members 63 that can be opened and closed as desired, as shown in FIGS. 6 and 7. Each separating member 63 has a distal end portion 63*a* (the right end portion as viewed in FIG. 6) that is pointed so that it can enter the gap between a pair of adjacent thin threads that are arranged in close proximity to each other. The separating member 63 further has a slant portion 63*b* that is contiguous with the pointed end portion 63*a*. The slant portion 63*b* is angulated with respect to a proximal portion 63*c* so that, when the separating members 63 which are open, as shown by the chain line in FIG. 6, are closed, as shown in FIG. 7, the slant portions 63*b* cause a thread l to be drawn toward the rear end (the left end as viewed in FIG. 7). The rear ends of the pair of separating members 63 are pivotably supported by a pin 64 inside the body 61 so that the separating members 63 can be simultaneously pivoted in opposite directions by a known actuating means (not shown), for example, a solenoid, a cam lever, etc. It should be noted that the pair of separating members 63 are not disposed within the same plane but are slightly vertically offset from each other so that they can assume the position that is shown in FIG. 7.

The cutter 65 may have the same structure as that of a known pair of scissors and is activated by a known actuating means that is provided inside the body 61 in the same way as in the case of the separating hook 62.

A lever 67 is pivotably provided on the forward end face of the body 61 so as to extend into the area between the separating hook 62 and the cutter 65. The lever 67 is pushed at one end thereof (the right end as viewed in FIG. 3) by a thread l when separated by the separating hook 62 and drawn into the slit 52 in the thread guide member 5, thus turning on a switch 68 having a known structure, which is attached to the body 61. When the switch 68 is turned on, the cutter 65 is activated to cut the separated thread by a controller (not shown) that controls the entire operation of this thread separating apparatus.

The detector 7 may have a known structure which has a light-emitting unit 71 and a light-receiving unit 72, e.g., a photosensor, a camera, etc., which face each other across threads l, these units 71 and 72 being secured to the slide table 3 through respective mounting members 75, so that it is possible to detect the outermost thread (the closest to the separating apparatus) and measure the diameter of this thread without touching it. The detector 7 is also connected to the above-described controller, which controls the entire operation of the thread separating apparatus.

It should be noted that the feed table 2 per se is also movable, by a known means through a predetermined distance along a rail that is provided along the direction of movement of the slide table 3, although the arrangement thereof is not shown. The feed table 2 can travel a greater distance than the slide table 3.

The operation of the thread separating apparatus having the above-described structure will next be explained.

As the second movable table or the slide table 3 moves rightward as viewed in FIG. 2, all the units of the apparatus except for the feed table 2 move together with the slide table 3. When the detector 7 detects the outermost thread, the detected signal is inputted to the controller to stop the slide table 3. The detector 7 detects the diameter of the thread at the same time and inputs the detected signal to the controller. Consequently, the controller makes a calculation while taking into account the diameter of the thread to determine a necessary amount of movement of the second movable table or the slide table 3. Then, the controller activates the pulse motor 42 of the drive mechanism 4 to advance the slide table 3 toward the threads (rightward as viewed in FIG. 2) by the calculated amount of movement. It should be noted that, at this time, the pair of separating members 63 of the separating hook 62 have been opened in advance so that a thread can pass through the gap between the distal ends 63*a*, as shown by the chain line in FIG. 6. The slide table 3 is stopped at a position where the distal ends 63*a* of the separating members 63, when coming closest to each other, will enter the gap between the outermost thread l and the thread l next to it, as shown by the solid line in FIG. 6. This position has previously been determined from the relationship between the detected position of the detector 7 and the positions of the distal ends 63*a* of the separating members 63. In regard to the thread guide member 5, at this time the threads l have been introduced into the slit 52 from the bottom of the V-notch 51 and sligned with each other therein.

As has been described above, when the slide table 3 stops after the advancement, the pair of separating members 63 of the separating hook 62 are activated to shift from the position shown by the solid line in FIG. 6 to the position that is shown in FIG. 7. Consequently, the outermost thread is drawn toward the body 61 by the action of the slant portions 63*b* of the separating members 63 and is thus separated from the other threads. The separated thread is then drawn as far as the inner part of the slit 52 in the thread guide member 5 while pushing the lever 67, thus turning on the switch 68. When the switch 68 turns on, the cutter 65 is activated to cut the separated thread. In this way, one cycle of a thread separating operation is completed.

When such an operating cycle is repeated a plurality of times, the slide table 3 reaches the limit of movement. Thus, after the operating cycle has been repeated a predetermined number of times, the slide table 3 is returned to the previous position by the drive mechanism 4, and the first movable table, that is, the feed table 2, is moved counter to the direction in which the slide table 3 has been moved and by the same distance as that through which the slide table 3 has been moved. Thereafter, the operating cycle is repeated again to separate the threads one by one.

Although in the foregoing embodiment the separating hook 62, the cutter 65, the switch 68, etc. are attached to the body 61 of the reaching unit 6, which is a separate member from the slide table 3, it should be noted that these members may be attached directly to the slide table 3. In addition, the first and second movable tables may be formed as one integral structure.

The present invention provides the following advantages.

(1) The slide table is moved through a distance that is calculated with the diameter of a thread being taken into account in order to position a separating hook having two pointed distal ends, and the thread is separated from the other threads by the distal ends. There is therefore no possibility of an error being made in which two threads are separated at a time.

(2) It is unnecessary to replace the attachments even when the diameter of the threads changes.

(3) Since threads are sligned by means of a slant slit, even if the diameter of threads to be handled changes (e.g., from 0.03 mm to 0.05 mm in diameter), it is unnecessary to replace the guide member with one which has a different slit width.

Although the best mode contemplated by the inventor for carrying out the present invention has been shown and described herein, it will be apparent to those skilled in the art that suitable modifications, variations, and equivalents may be made without departing from the scope of the invention, such a scope being limited solely by the terms of the following claims.

What is claimed is:

1. A thread separating apparatus for separating an outermost thread from a large number of threads arranged substantially parallel and in close proximity of each other within one plane, said apparatus comprising:

a movable table that is movable in a direction which is parallel to the plane in which the threads are arranged and which direction is substantially perpendicular to the threads;

a thread guide member that projects from said movable table in the direction of movement of said movable table, said guide member having a slit in which threads are to be aligned;

separating means for separating the outermost thread from the rest of the threads, said separating means projecting from said movable table in the direction of movement of said movable table, and said separating means having a pair of separating members which can be opened and closed as desired;

detector means for detecting in a noncontact manner a diameter of the thread to be separated, said detector means being provided on said movable table; and switch means provided on said movable table and activatable by a thread being separated by said separating means for detecting when the thread has been separated from the rest of the threads by a predetermined amount.

2. A thread separating apparatus according to claim 1, wherein said separating members of said separating means have respective angulated portions that separate the outermost thread from the rest of the threads.

3. A thread separating apparatus according to claim 1 wherein said thread guide member has a divergent V-notch formed at the open end of said slit.

4. A thread separating apparatus according to claim 1 wherein said slit is slanted with respect to the direction of extension of a thread which is to be separated.

5. A thread separating apparatus according to claim 3, wherein said slit is slanted with respect to the direction of extension of a thread which is to be separated.

6. A thread separating apparatus according to claim 1, further comprising a lever that is pivotably mounted in the apparatus relative to said movable table at a forward end thereof, said lever being pivotable by the separated thread and operatively connected to said switch so as to activate said switch when pivoted by the thread being separated by said separating means.

7. A thread separating apparatus according to claim 3, further comprising a lever that is pivotably mounted in the apparatus relative to said movable table at a forward end thereof, said lever being pivotable by the separated thread and operatively connected to said switch so as to activate said switch when pivoted by the thread being separated by said separating means.

8. A thread separating apparatus according to claim 2, wherein said thread guide member has a divergent V-notch formed at the open end of said slit.

9. A thread separating apparatus according to claim 2, wherein said slit is slanted with respect to the direction of extension of a thread which is to be separated.

10. A thread separating apparatus according to claim 8, wherein said slit is slanted with respect to the direction of extension of a thread which is to be separated.

11. A thread separating apparatus according to claim 2, further comprising a lever that is pivotably mounted in the apparatus relative to said movable table at a forward end thereof, said lever being pivotable by the separated thread and operatively connected to said switch so as to activate said switch when pivoted by the thread being separated by said separating means.

12. A thread separating apparatus according to claim 4, further comprising a lever that is pivotably mounted in the apparatus relative to said movable table at a forward end thereof, said lever being pivotable by the separated thread and operatively connected to said switch so as to activate said switch when pivoted by the thread being separated by said separating means.

13. A thread separating apparatus according to claim 8, further comprising a lever that is pivotably mounted in the apparatus relative to said movable table at a forward end thereof, said lever being pivotable by the separated thread and operatively connected to said switch so as to activate said switch when pivoted by the thread being separated by said separating means.

14. A thread separating apparatus according to claim 1, and further comprising cutter means projecting from said movable table in the direction of movement of said movable table for cutting the separated thread, said cutter means operatively connected to said switch means so as to be operated when said switch means detects that the outermost thread has been separated from the rest of the threads by said predetermined amount.

* * * * *